United States Patent [19]

Hattori et al.

[11] Patent Number: 4,708,068

[45] Date of Patent: Nov. 24, 1987

[54] FLUIDIZED-BED INCINERATION EQUIPMENT FOR REMOVING ORGANIC SUBSTANCES

[75] Inventors: Hisashi Hattori; Hidemitsu Takenoshita; Yoichiro Hanada, all of Hirakata, Japan

[73] Assignee: Kabushiki Kaisha Komatsu Seisakusho, Tokyo, Japan

[21] Appl. No.: 897,969

[22] Filed: Aug. 20, 1986

[51] Int. Cl.[4] ..... F23G 5/30

[52] U.S. Cl. ..... 110/245; 110/188; 110/217; 110/263; 110/264

[58] Field of Search ..... 110/203, 216–217, 110/233, 235, 243–245, 263, 264, 346, 185–188; 122/4 D; 236/15 R, 15 BD; 165/104.16; 34/57 A; 432/15, 58; 431/7, 170, 328, 173, 165, 196

[56] References Cited

U.S. PATENT DOCUMENTS

| | | | |
|---|---|---|---|
| 2,823,740 | 2/1958 | Morck, Jr. | 236/15 BD |
| 3,888,194 | 6/1975 | Kishigami et al. | 110/245 |
| 4,220,445 | 9/1980 | James et al. | 110/216 X |
| 4,239,480 | 12/1980 | Hyre | 110/245 X |
| 4,359,005 | 11/1982 | Baston | 110/245 |
| 4,423,688 | 1/1984 | Kyo | 110/245 |
| 4,455,969 | 6/1984 | Barker | 110/245 X |
| 4,599,953 | 7/1986 | Gould | 110/216 X |

FOREIGN PATENT DOCUMENTS

| | | | |
|---|---|---|---|
| 819 | 1/1980 | Japan | 110/245 |
| 77815 | 5/1982 | Japan | 110/203 |

*Primary Examiner*—Albert J. Makay
*Assistant Examiner*—Steven E. Warner
*Attorney, Agent, or Firm*—Armstrong, Nikaido, Marmelstein & Kubovcik

[57] ABSTRACT

An incineration equipment for removing organic substances from various parts of an extruder in a plastics forming machine, has a combustion chamber formed in the upper portion of a heating furnace accommodating a fluidized-bed consisting of refractory particles therein, into which furnace the various parts are to be thrown, and a burning system for heating the fluidized-bed and also for causing gaseous decomposed polymers produced by thermal decomposition of the organic substances and mixed with air fed from the bottom of the furnace through a porous dispersion plate to burn in the combustion chamber. This burning system connects through a single directional control valve with a fuel tank and an air tank, and it comprises a burner having its tip end opened in the combustion chamber, and a temperature sensor for sensing the temperature in the furnace and outputting an operation signal for actuating the directional control valve in accordance with the sensed furnace temperature.

3 Claims, 3 Drawing Figures

FLUIDIZED-BED INCINERATION EQUIPMENT FOR REMOVING ORGANIC SUBSTANCES

BACKGROUND OF THE INVENTION

1. Field of the invention

The present invention relates to an incineration equipment for removing organic substances such as plastics, paint, oil, etc. adhering to extruder parts in a plastics forming machine, hangers for painting and other metallic and ceramic parts from these parts. More particularly, it relates to a fluidized-bed incineration equipment, in which parts having organic substances adhering thereto are thrown into a furnace accommodating a fluidized-bed consisting of refractory particles and the organic substances are removed from the parts through thermal decomposition by heating.

2. Description of the prior art

Heretofore, in the case of removing organic substances from various parts by making use of a fluidized-bed furnace accommodating a fluidized-bed consiting of refractory particles, the fluidized-bed is heated by disposing , heaters along the periphery of the furnace accommodating the fluidized-bed, hence the organic substances adhering to the parts are thermally decomposed by heat generated by the heaters, and they are transformed into decomposed polymers. These decomposed polymers are mixed with air that is fed from the bottom of the furnace through a porous dispersion plate for the purpose of causing the fluidized-bed to flow, and the mixture is discharged as an exhaust gas from the top of the furnace through an exhaust piping. Since harmful decomposed polymers are contained in the discharged exhaust gas, in order to treat these harmful decomposed polymers, in the exhaust piping are successively disposed a cyclone, a scrubber, an exhaust fan, and further an after-burner device, so that the exhaust gas is discharged to the atmosphere after it has passed through these devices.

The above-mentioned fluidized-bed incineration equipment for removing organic substances in the prior art has a disadvantage that energy consumption for heating is large and the entire equipment becomes large-scaled, because heating means are necessitated at two locations, that is, in the heating furnace main body and in the after-burner device, and a cyclone, a scrubber, an exhaust fan, and further an after-burner device are required. Furthermore, in the fluidized-bed incineration equipment for removing organic substances in the prior art, in order that the temperature of the fluidized-bed can be prevented from rising too high due to oxidation of the decomposed polymers, combustion of the decomposed polymers is prevented by spraying water into the furnace, and so, an apparatus for that purpose is necessary.

SUMMARY OF THE INVENTION

The present invention has been worked out for the purpose of eliminating the above-described disadvantage of the equipment in the prior art, and one object of the present invention is to provide incineration equipment for removing organic substances in which saving of energy necessitated for heating can be achieved and also remarkable reduction in size and cost of the entire equipment can be realized.

Another object of the present invention is to provide incineration equipment for removing organic substances in which a temperature within an incineration furnace can be regulated with a simple system.

In order to achieve the aforementioned various objects, according to one aspect of the present invention, there is provided an incineration equipment for removing organic substances comprising a combustion chamber formed in the upper portion of a heating furnace accommodating a fluidized-bed consisting of refractory particles, into which chamber are introduced parts with organic substances adhering thereto, a burning system for heating the fluidized-bed and for burning gaseous decomposed polymers which are produced by thermal decomposition of the organic substances and mixed with air fed from the bottom of the furnace into the furnace through a porous dispersion plate in the combustion chamber, and a furnace lid disposed in a freely openable and closeable manner at the top opening portion of the furnace.

According to a second aspect of the present invention, there is provided the aforementioned incineration equipment for removing organic substances, characterized in that the burning system includes a main burner with its tip end opening at the combustion chamber, a pilot burner with its tip end likewise opening at the combustion chamber and disposed in the proximity of the main burner in order to ignite the main burner, a fuel feed circuit for feeding fuel from a fuel tank to the main burner and the pilot burner, an air feed circuit for feeding air from an air tank to the bottom of the furnace and to the main burner, a solenoid-operated directional control valve for switching over the fuel feed circuit and the air feed circuit to the main burner in order to feed either fuel or air to the main burner, a furnace temperature sensor for sensing a temperature within the furnace to output a temperature sense signal, and means responsive to the signal output from the furnace temperature sensor for controlling the solenoid-operated directional control valve.

According to a third aspect of the present invention, there is provided the aforementioned incineration equipment for removing organic substances, characterized in that the main burner and the pilot burner are disposed in the upper portion of the wall of the furnace as directed in the direction eccentric from the center axis of the furnace so as to eject combustion gas along the inner wall of the surface, and thereby swirl of the combustion gas is generated within the combustion chamber.

According to a fourth aspect of the present invention, there is provided the aforementioned incineration equipment for removing organic substances, characterized in that the tip ends of the respective ones of the main burner and the pilot burner are projected either in the horizontal direction or in the obliquely downward direction at an angle of 30° or less with respect to the horizontal direction.

According to a fifth aspect of the present invention, there is provided the aforementioned incineration equipment for removing organic substances, characterized in that the furnace lid is provided with a filter.

According to a sixth aspect of the present inventions, there is provided the aforementioned incineration equipment for removing organic substances, characterized in that the equipment further comprises a filter located at the middle level within the combustion chamber and disposed horizontally at a position lower than the tip ends of the respective ones of the main burner and the pilot burner.

The above and many other advantages, features and additional objects of the present invention will become manifest to those versed in the art upon making reference to the following detailed description and accompanying drawings in which preferred structural embodiments incorporating the principles of the present invention are shown by way of illustrative example.

DETAILED DESCRIPTION OF THE PREFERRED EMBODIMENTS

Figure 1:
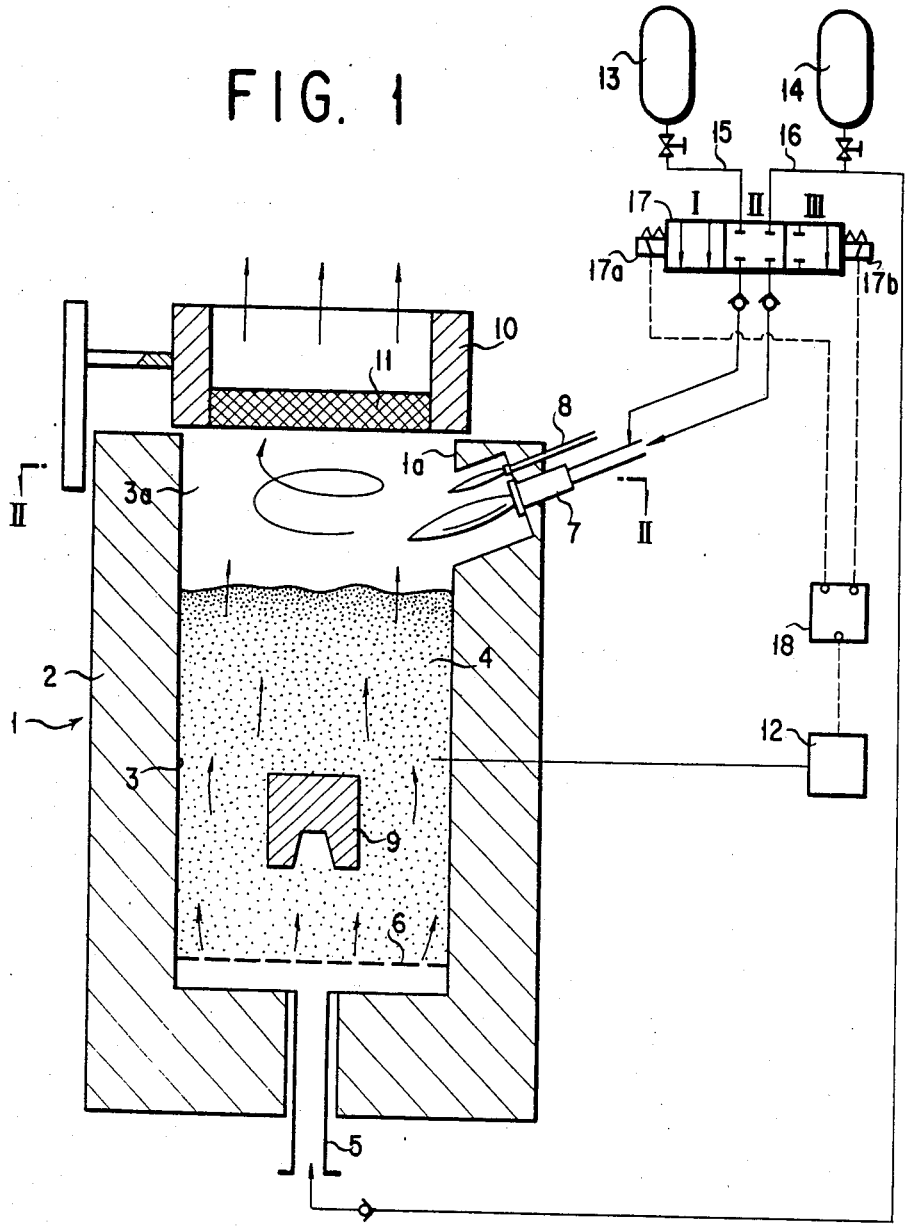
FIG. 1 is a schematic view partly in cross-section showing one preferred embodiment of the fludized-bed incineration equipment for removing organic substances according to the present invention.

One preferred embodiment of the present invention will be described in greater detail with reference to FIGS. 1 and 2 of the accompanying drawings. At first, in FIG. 1, reference numeral 1 designates a furnace main body, in which a fluidized-bed 4 consisting of refractory particles such as alumina is accommodated within a furnace inner chamber 3 surrounded by a furnace wall 2 made of heat-insulating material. To the bottom of the above-mentioned furnace inner chamber 3 is connected an air feed pipe 5 so that air may be fed into the furnace inner chamber 3 within the furnace wall 2, and the air fed into the furnance inner chamber 3 is dispersed by a gas dispersion plate 6 consisting of a porous plate and then flows into the fluidized-bed 4 as shown by arrows to cause the fluidized-bed 4 to flow.

The upper portion of the furnace inner chamber 3 serves as a combustion chamber 3*a*, and into this combustion chamber 3*a* are projected tip ends of a main burner 7 and a pilot burner 8 for igniting the main burner 7 both penetrating through the furnace wall 2 and as directed in the horizontal direction or in an obliquely downward direction at an angle of 30° or less with respect to the horizontal direction.

On the other hand, the upper portion of the furnace main body 1 has an aperture 1*a* for throwing parts into the furnace inner chamber 3, and this aperture 1*a* is adapted to be closed by a furnace lid 10 that is provided in a freely openable and closeable manner. Within the furnace lid 10 is provided a filter 11, so that after the refractory particles such as alumina mixed in the exhaust gas have been separated by this filter, only exhaust gas is discharged to the atmosphere.

Figure 2:
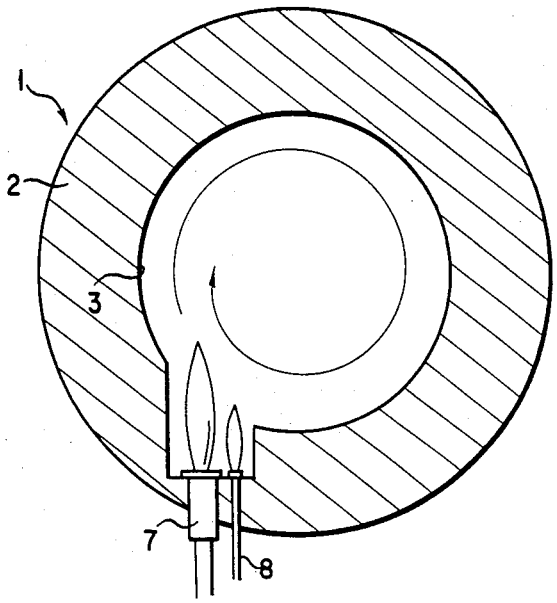
FIG. 2 is a cross-sectional view taken along line II—II in FIG. 1 as viewed in the direction of arrows.

In addition, as shown in FIG. 2, the main burner 7 and the pilot burner 8 are disposed in the upper portion of the furnace wall as directed in the direction eccentric from the center axis of the furnace, that is, as directed in the direction deviated by an appropriate angle from the radial direction of the furnace so as to eject combustion gas along the inner wall of the furnace inner chamber 3, and thereby swirl of combustion gas is generated within the combustion chamber 3*a*. As a result, the furnace inner chamber 3 and the fluidized-bed 4 can be efficiently heated, and at the same time the exhaust gas containing decomposed polymers produced by thermal decomposition of organic substances adhering to the parts 9 thrown into the fluidized-bed 4, can be burnt within the combustion chamber 3*a*.

Moreover, in the incineration equipment according to the present invention, the temperature in the furnace inner chamber 3 can be controlled so as to be maintained always at a preset furnace temperature, for example, at 450° C.

More particularly, as shown in FIG. 1, the temperature in the furnace inner chamber 3 is continuously sensed by a temperature sensor 12 such as, for instance, a thermocouple. On one hand, to the main burner 7 is connected a fuel feed circuit 15 for feeding fuel from a fuel tank 13 through a check valve, and further to the main burner 7 is connected an air feed circuit for feeding air from an air tank 14 through a check valve. On the other hand, to the pilot burner 8 are continuously fed fuel and air. In addition, between the fuel and air feed circuits 15 and 16 and the main burner 7 is provided a solenoid-operated control valve 17 for switching over these circuits. This valve 17 has a valve position I for feeding fuel, a neutral valve position (blocking valve position) II and a valve position III for feeding air. Normally the valve 17 is made to position at the neutral valve position II, and switching over to each valve positions I or III is achieved by energizing the solenoid 17*a* or 17*b* on the corresponding side.

Thus, in the case where the temperature in the furnace inner chamber has become higher than the preset furnace temperature, for example, by 10°-20° C., then the control valve 17 is automatically actuated so that only air may be fed to the main burner 7, thereby the furnace inner chamber 3 is cooled, while in the case where the temperature in the furnace inner chamber has become lower than the preset furnace temperature, for example, by 10°-20° C., then fuel is fed to the main burner 7, and thereby the furnace inner chamber 3 is heated by the combustion gas in the combustion chamber 3*a*.

Figure 3:
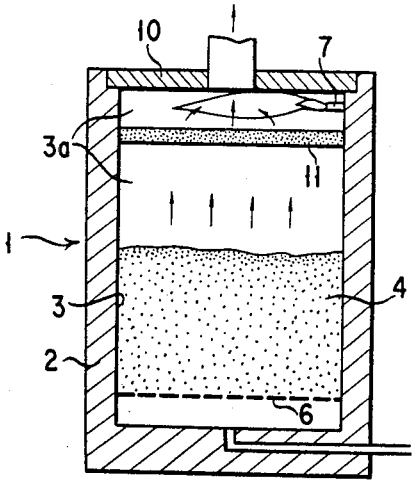
FIG. 3 is a schematic cross-sectional view showing another preferred embodiment of an incineration furnace in the fluidized-bed incineration equipment for removing organic substances according to the present invention.

While provision is made such that the filter 11 is disposed above the combustion chamber 3*a* to remove refractory particles in the exhaust gas burnt in the combustion chamber 3*a* in the above-described preferred embodiment, the filter 11 could be disposed within the combustion chamber 3*a* under the main burner 7 as shown in FIG. 3, so that the organic substances in the exhaust gas may be burnt and removed by the main burner 7 after the refractory particles or the like in the exhaust gas have been removed by the filter 11.

In the latter case, by employing a ceramic filter having a high heat-resistant property as the filter 11, heat in the upper layer portion in the combustion chamber 3*a* can be efficiently transmitted to the fluidized-bed 4, and it becomes possible to burn the organic substances in the exhaust gas as well as the organic substances adhering to the filter 11 without disturbing the atmosphere within the furnace main body 1.

What is claimed is:

1. A fluidized-bed incinerator comprising:

(a) a heating furnace accomodating a fluidized-bed consisting of refractory particles and having a combustion chamber formed in an upper portion thereof;

(b) a burner system for heating said fluidized-bed and for burning gaseous effluent produced by thermal decomposition within said bed, said burner system including a main burner diosposed in the upper portion of the wall of said furnace, above the level of the fluidized-bed of refractory particles and directed eccentric from the center axis of the furnace and at an angle from the horizontal between 0° and 30° downward, a pilot burner with its tip end opening toward said combustion chamber and disposed in the proximity of said main burner;

(c) a fuel feed circuit for feeding fuel from a fuel tank to said main burner and said pilot burner;

(d) an air feed circuit for feeding air from a tank to the bottom of said furnace and to said main burner, said air feed circuit including a solenoid-operated directional control valve for switching said fuel feed circuit and said air feed circuit to said main burner so as to provide, selectively, fuel and air to said main burner and being controlled by a means responsive a furnace temperature sensor;

(e) a porous dispersion plate located above the bottom of said heating furnace and defining the bottom of said fluidized-bed, said dispersion plate having a plurality of passages whereby air delivered to the bottom of said furnace is distributed evenly to the bottom of said fluidized-bed; and (f) a furnace lid disposed in an openable and closable manner at a top opening portion of said furnace, said lid having an opening communicating said combustion chamber to the exterior of said furnace, said opening having therein a filter.

2. An equipment as claimed in claim 1, characterized in that said furnace lid is provided with a ceramic filter.

3. An equipment as claimed in claim 1, further comprising a ceramic filter located at the middle level within the combustion chamber and disposed horizontally at a position lower than the tip ends of the respective ones of the main burner and the pilot burner.

* * * * *